US012765642B2

(12) United States Patent
Taoka et al.

(10) Patent No.: US 12,765,642 B2
(45) Date of Patent: Oct. 20, 2026

(54) SHOE

(71) Applicant: ASICS CORPORATION, Kobe (JP)

(72) Inventors: Azumi Taoka, Kobe (JP); Sho Takamasu, Kobe (JP); Koji Otobe, Kobe (JP); Tomoichiro Ozaki, Kobe (JP); Hiroki Uzawa, Kobe (JP)

(73) Assignee: ASICS CORPORATION, Kobe (JP)

( * ) Notice: Subject to any disclaimer, the term of this patent is extended or adjusted under 35 U.S.C. 154(b) by 92 days.

(21) Appl. No.: 18/854,871

(22) PCT Filed: Apr. 15, 2022

(86) PCT No.: PCT/JP2022/017930
§ 371 (c)(1),
(2) Date: Oct. 7, 2024

(87) PCT Pub. No.: WO2023/199516
PCT Pub. Date: Oct. 19, 2023

(65) Prior Publication Data

US 2025/0338919 A1 Nov. 6, 2025

(51) Int. Cl.
*A43B 23/02* (2006.01)

(52) U.S. Cl.
CPC ..... *A43B 23/0265* (2013.01); *A43B 23/0295* (2013.01)

(58) Field of Classification Search
USPC ..... 36/45
See application file for complete search history.

(56) References Cited

U.S. PATENT DOCUMENTS 6,108,943 A * 8/2000 Hudson ..... A43C 1/04 36/31
2005/0076536 A1 4/2005 Hatfield et al.
2013/0008053 A1 1/2013 Nishiwaki et al.
(Continued)

FOREIGN PATENT DOCUMENTS

JP S58-173305 U 11/1983
JP S60-180511 U 11/1985
(Continued)

OTHER PUBLICATIONS

International Search Report issued in PCT/JP2022/017930 mailed on Jun. 14, 2022.

*Primary Examiner* — Matthew R Marchewka
(74) *Attorney, Agent, or Firm* — Studebaker Brackett PLLC

(57) ABSTRACT

A shoe includes a sole and an upper. The upper includes: a topline portion; a slit portion; a peripheral edge portion; and a forefoot portion covering portion. The forefoot portion covering portion includes: an inner functional portion; and an outer functional portion. The inner functional portion has: a plurality of inner high rigidity portions; and a plurality of inner low rigidity portions. The outer functional portion has: a plurality of outer high rigidity portions; and a plurality of outer low rigidity portions. A length between ends on an outer side in the foot width direction, of the outer low rigidity portions adjacent to each other in the foot length direction, is longer than a length between ends on the inner side in the foot width direction, of the inner low rigidity portions adjacent to each other in the foot length direction.

10 Claims, 24 Drawing Sheets

(56) References Cited

U.S. PATENT DOCUMENTS

| | | | | |
|---|---|---|---|---|
| 2014/0173934 | A1* | 6/2014 | Bell | A43C 11/002 36/84 |
| 2015/0082668 | A1* | 3/2015 | Nonogawa | A43B 7/144 36/30 R |
| 2015/0342261 | A1 | 12/2015 | Boucher et al. | |
| 2017/0143075 | A1* | 5/2017 | Nonogawa | A43B 23/0275 |
| 2017/0215523 | A1* | 8/2017 | Nishiwaki | A43B 23/0275 |

FOREIGN PATENT DOCUMENTS

| | | | |
|---|---|---|---|
| JP | H09-123315 | A | 5/1997 |
| JP | 2011-136252 | A | 7/2011 |
| JP | 2016-504106 | A | 2/2016 |
| WO | 2011129017 | A1 | 10/2011 |

* cited by examiner

SHOE

TECHNICAL FIELD

The present disclosure relates to a shoe.

BACKGROUND

Generally, in a shoe used for ball sports or the like, there is a demand for a shoe that is excellent not only in a running assisting function but also in an assisting function for swiftly and smoothly performing a change in direction (so-called cutting maneuver). For example, WO2011/129017 discloses a structure of a forefoot portion of an upper of a shoe including a high rigidity region and a low rigidity region that is easier to extend and easier to bend than the high rigidity region. The low rigidity region has a plurality of inner flexible portions formed on the inner side in a foot width direction, and a plurality of outer flexible portions formed on the outer side in the foot width direction. The flexible portions are spaced apart from each other in a foot length direction. The high rigidity region has an inner reinforcing portion arranged between the inner flexible portions adjacent to each other, and an outer reinforcing portion arranged between the outer flexible portions adjacent to each other.

CITATION LIST

Patent Literature

PTL 1: WO2011/129017

SUMMARY

Technical Problem

In sports (such as tennis) in which a cutting maneuver is frequent, it is concerned that a toe of a wearer is locally compressed when creases are generated in a forefoot portion of an upper at the time of a cutting maneuver.

An object of the present disclosure is to provide a shoe capable of suppressing generation of creases in an upper at the time of a cutting maneuver.

Solution to Problem

A shoe according to an aspect of the present disclosure is a shoe including a sole and an upper, wherein the upper includes: a topline portion that allows a wearer of the shoe to put a foot of the wearer in and out of the shoe; a slit portion that defines an opening extending frontward in a foot length direction from the topline portion; a peripheral edge portion connected to the sole; and a forefoot portion covering portion that covers a forefoot portion of the wearer of the shoe, the forefoot portion covering portion includes: an inner functional portion formed on an inner side in a foot width direction and between the slit portion and the peripheral edge portion; and an outer functional portion formed on an outer side of the inner functional portion in the foot width direction and between the slit portion and the peripheral edge portion, the inner functional portion has: a plurality of inner high rigidity portions arranged so as to be aligned in the foot length direction, each of the plurality of inner high rigidity portions having a shape extending in the foot width direction; and a plurality of inner low rigidity portions arranged between the inner high rigidity portions adjacent to each other in the foot length direction, each of the plurality of inner low rigidity portions having a bending rigidity lower than a bending rigidity of each of the plurality of inner high rigidity portions and having a shape extending in the foot width direction, the outer functional portion has: a plurality of outer high rigidity portions arranged so as to be aligned in the foot length direction, each of the plurality of outer high rigidity portions having a shape extending in the foot width direction; and a plurality of outer low rigidity portions arranged between the outer high rigidity portions adjacent to each other in the foot length direction, each of the plurality of outer low rigidity portions having a bending rigidity lower than a bending rigidity of each of the plurality of outer high rigidity portions and having a shape extending in the foot width direction, and a length between ends on an outer side in the foot width direction, of the outer low rigidity portions adjacent to each other in the foot length direction, is longer than a length between ends on the inner side in the foot width direction, of the inner low rigidity portions adjacent to each other in the foot length direction.

Advantageous Effects of Invention

According to the present disclosure, there can be provided a shoe capable of suppressing generation of creases in an upper at the time of a cutting maneuver.

DETAILED DESCRIPTION

Figure 1:
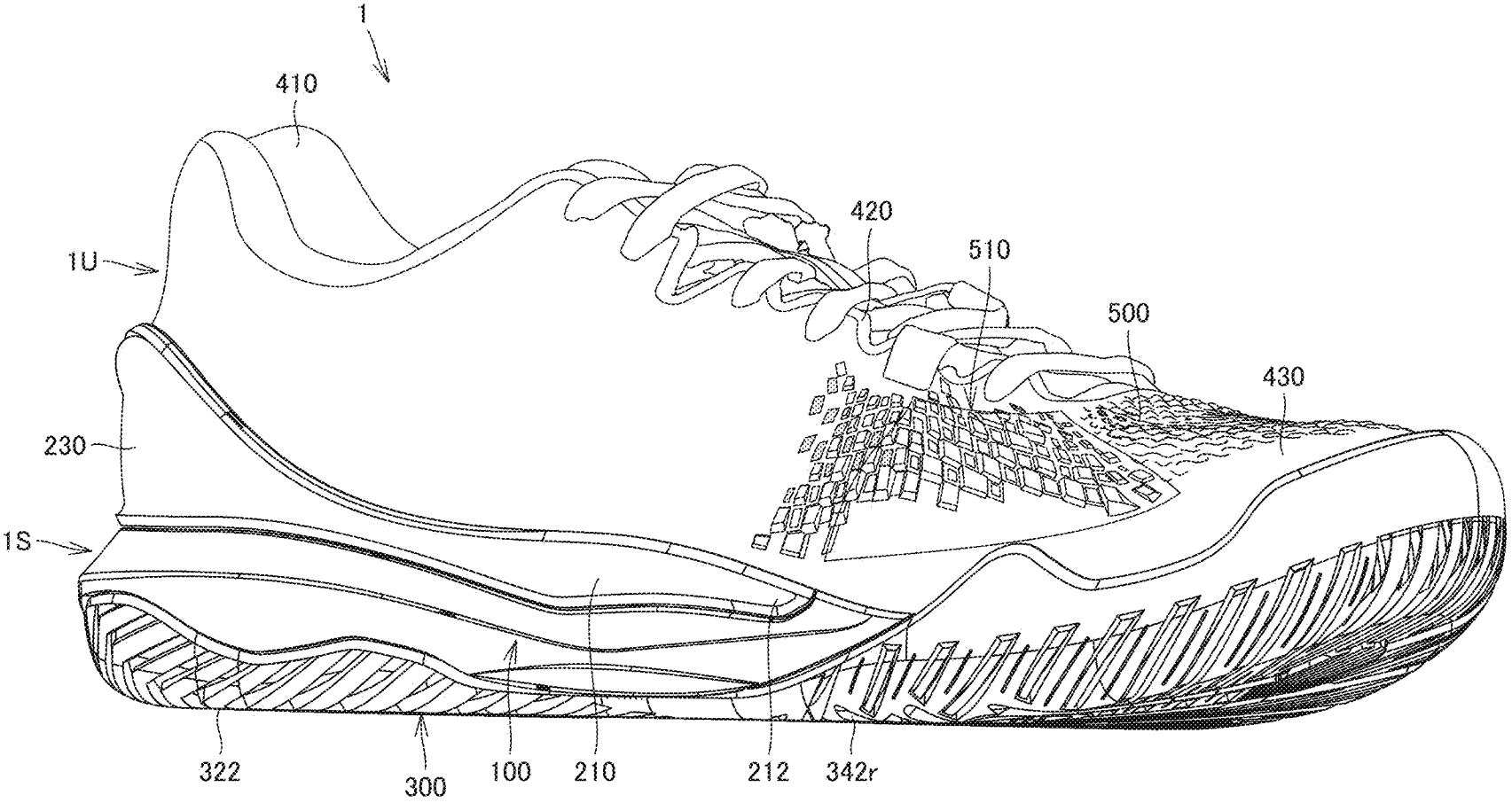
FIG. 1 is a perspective view schematically showing a shoe according to an embodiment of the present disclosure.

An embodiment of the present invention will be described with reference to the drawings. In the drawings to be referenced below, the same or corresponding members are denoted by the same numerals. In the following description, terms such as longitudinal direction, width direction, fore, and rear are used. Such directional terms indicate directions when viewed from a viewpoint of a wearer who wears a shoe 1 placed on a flat plane such as the ground. For example, the fore refers to the toe side, and the rear refers to the heel side. Further, the inner side refers to the first-toe side of a foot in the width direction, and the outer side refers to the fifth-toe side of the foot in the width direction.

Figure 2:
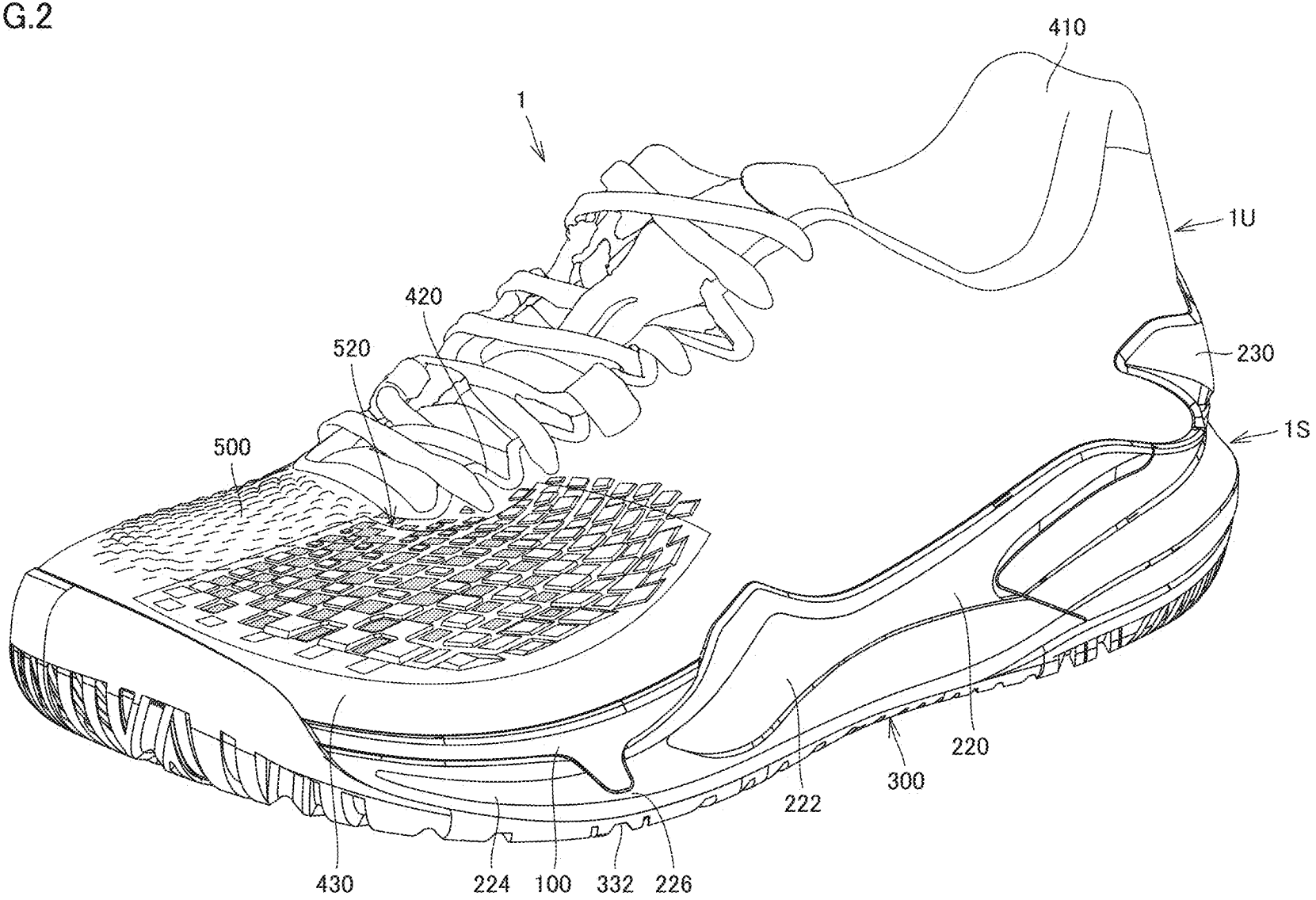
FIG. 2 is a perspective view schematically showing the shoe at an angle different from the angle in FIG. 1.
Figure 3:
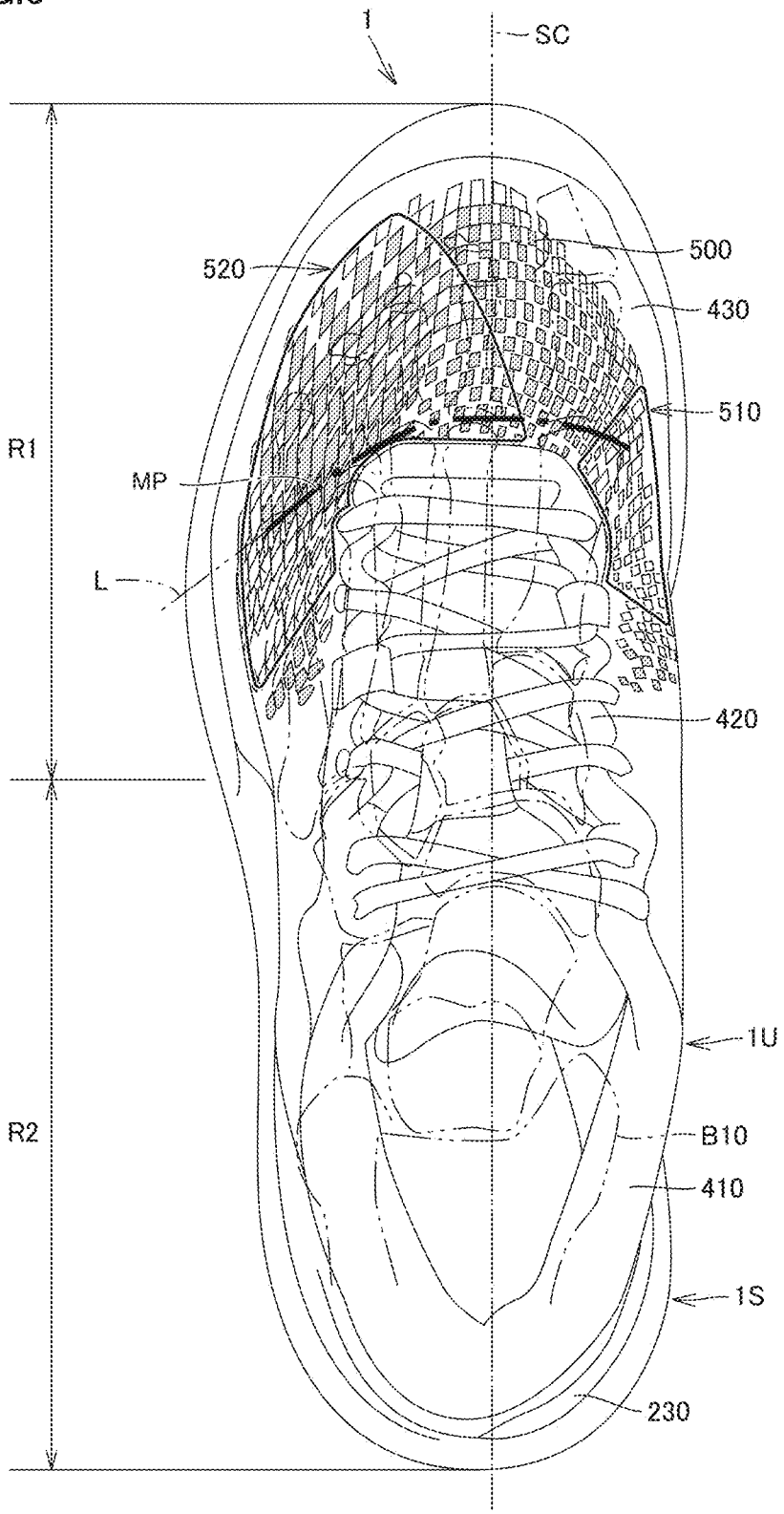
FIG. 3 is a plan view of the shoe.

FIG. 1 is a perspective view schematically showing a shoe according to an embodiment of the present disclosure. FIG. 2 is a perspective view schematically showing the shoe at an angle different from the angle in FIG. 1. FIG. 3 is a plan view of the shoe. The shoe 1 according to the present embodiment is suitable for shoes for court sports (such as tennis) in which a so-called cutting maneuver is frequent.

Although FIGS. 1 to 3 show the shoe 1 for a left foot, the shoe 1 is also applicable to a right foot. In this case, the shoe for the right foot is formed to have a shape symmetrical to or substantially similar to the shoe for the left foot.

As shown in FIGS. 1 to 3, the shoe 1 includes a sole 1S and an upper 1U.

<Sole>

First, the sole 1S will be described.

The sole 1S supports a foot of a wearer. As shown in FIG. 3, the sole 1S has a forefoot region R1 and a rearfoot region R2.

The forefoot region R1 is a region overlapping with a forefoot portion of the wearer of the shoe 1 in a thickness direction of the sole 1S. The forefoot portion is a portion located at a front part of the foot of the wearer in a foot length direction (up-down direction in FIG. 3) of the shoe 1. The forefoot region R1 is a region located in a range of approximately 0% to 50% from a front end to a rear end of the shoe 1 with respect to a total length of the shoe 1 along a shoe center SC (see FIG. 3).

The foot length direction is a direction parallel to the shoe center SC. It should be noted that the shoe center SC is not limited to a center line of the shoe 1 and may be a line corresponding to a straight line that connects a center of a calcaneus B10 and first and second toes of a standard wearer of the shoe 1.

The rearfoot region R2 is a region overlapping with a rearfoot portion of the wearer of the shoe 1 in the thickness direction of the sole 1S. The rearfoot portion is a portion located at a rear part of the foot of the wearer in the foot length direction. The rearfoot region R2 is a region located in a range of 50% to 100% from the front end to the rear end of the shoe 1 with respect to the total length of the shoe 1.

As shown in FIGS. 1 and 2, the sole 1S has a midsole 100, an inner reinforcing portion 210, an outer reinforcing portion 220, a heel reinforcing portion 230, and an outsole 300.

The midsole 100 mainly has a shock absorbing function when the foot contacts the ground. The midsole 100 is, for example, made of a resin-made foam material containing: a resin material as a main component; and a foaming agent and a crosslinking agent as sub-components. It should be noted that the material of the midsole 100 is not limited to the above-described material and the midsole 100 may be made of a resin or rubber material having excellent shock absorbing property while having proper strength.

The inner reinforcing portion 210 is provided on a side part of the midsole 100 on the inner side in a foot width direction. The inner reinforcing portion 210 is made of a material (e.g., a thermoplastic polyurethane resin or a nylon resin) higher in hardness than the material of the midsole 100 and a material of the upper 1U. The inner reinforcing portion 210 reinforces the upper 1U. The inner reinforcing portion 210 has a shape extending in the foot length direction. The inner reinforcing portion 210 has a function of allowing the heel side of the midsole 100 to twist inward with respect to the toe side of the midsole 100 when the foot takes off the ground at the time of a cutting maneuver. The inner reinforcing portion 210 covers a lower part of the upper 1U. A front end 212 of the inner reinforcing portion 210 in the foot length direction is located more rearward in the foot length direction than a position corresponding to a metatarsophalangeal (MP) joint (see FIG. 3) of the foot of the wearer.

The outer reinforcing portion 220 is provided on a side part of the midsole 100 on the outer side in the foot width direction. The outer reinforcing portion 220 is made of a material (e.g., a thermoplastic polyurethane resin or a nylon resin) higher in hardness than the material of the midsole 100 and the material of the upper 1U. The outer reinforcing portion 220 may be made of a material lower in hardness than the material of the inner reinforcing portion 210. The outer reinforcing portion 220 reinforces the upper 1U. The outer reinforcing portion 220 has a shape extending in the foot length direction. The outer reinforcing portion 220 has a function of suppressing a decrease in compression rigidity of the midsole 100. In the present embodiment, the outer reinforcing portion 220 also has a function of suppressing an increase in bending rigidity of the sole 1S in the vicinity of the MP joint of the foot of the wearer. As shown in FIG. 2, the outer reinforcing portion 220 has a rear reinforcing portion 222, a front reinforcing portion 224 and a bend allowing portion 226.

The rear reinforcing portion 222 is located more rearward in the foot length direction than an extension line L of the MP joint of the foot of the wearer. As shown in FIG. 2, the rear reinforcing portion 222 covers an outer side surface of the midsole 100 in the foot width direction.

The front reinforcing portion 224 is located more frontward in the foot length direction than the extension line L of the MP joint of the foot of the wearer. The front reinforcing portion 224 covers the outer side surface of the midsole 100 in the foot width direction. The front reinforcing portion 224 has such a shape that an upper part of the outer side surface of the midsole 100 is exposed.

The bend allowing portion 226 is located on the extension line L of the MP joint and couples the rear reinforcing portion 222 to the front reinforcing portion 224. The bend allowing portion 226 allows the front reinforcing portion 224 to bend with respect to the rear reinforcing portion 222. In the present embodiment, the bend allowing portion 226 is implemented by a notch that is opened upward.

The heel reinforcing portion 230 reinforces a heel portion of the upper 1U. The heel reinforcing portion 230 is made of a material (e.g., a thermoplastic polyurethane resin or a nylon resin) higher in hardness than the material of the midsole 100 and the material of the upper 1U. The heel reinforcing portion 230 has a function of suppressing bending of the heel portion of the upper 1U when the foot takes off the ground at the time of a cutting maneuver, for example. The heel reinforcing portion 230 covers a part of the heel portion of the upper 1U. The heel reinforcing portion 230 is continuous to a rear end of the inner reinforcing portion 210. The heel reinforcing portion 230 may be made of the same material as the material of the inner reinforcing portion 210, or may be made of a material different from the material of the inner reinforcing portion 210.

The outsole 300 is arranged on the lower surface side of the midsole 100. In the present embodiment, the outsole 300 is connected to a lower surface of the midsole 100. The outsole 300 constitutes a ground contact portion. The outsole 300 is made of rubber or the like.

Figure 4:
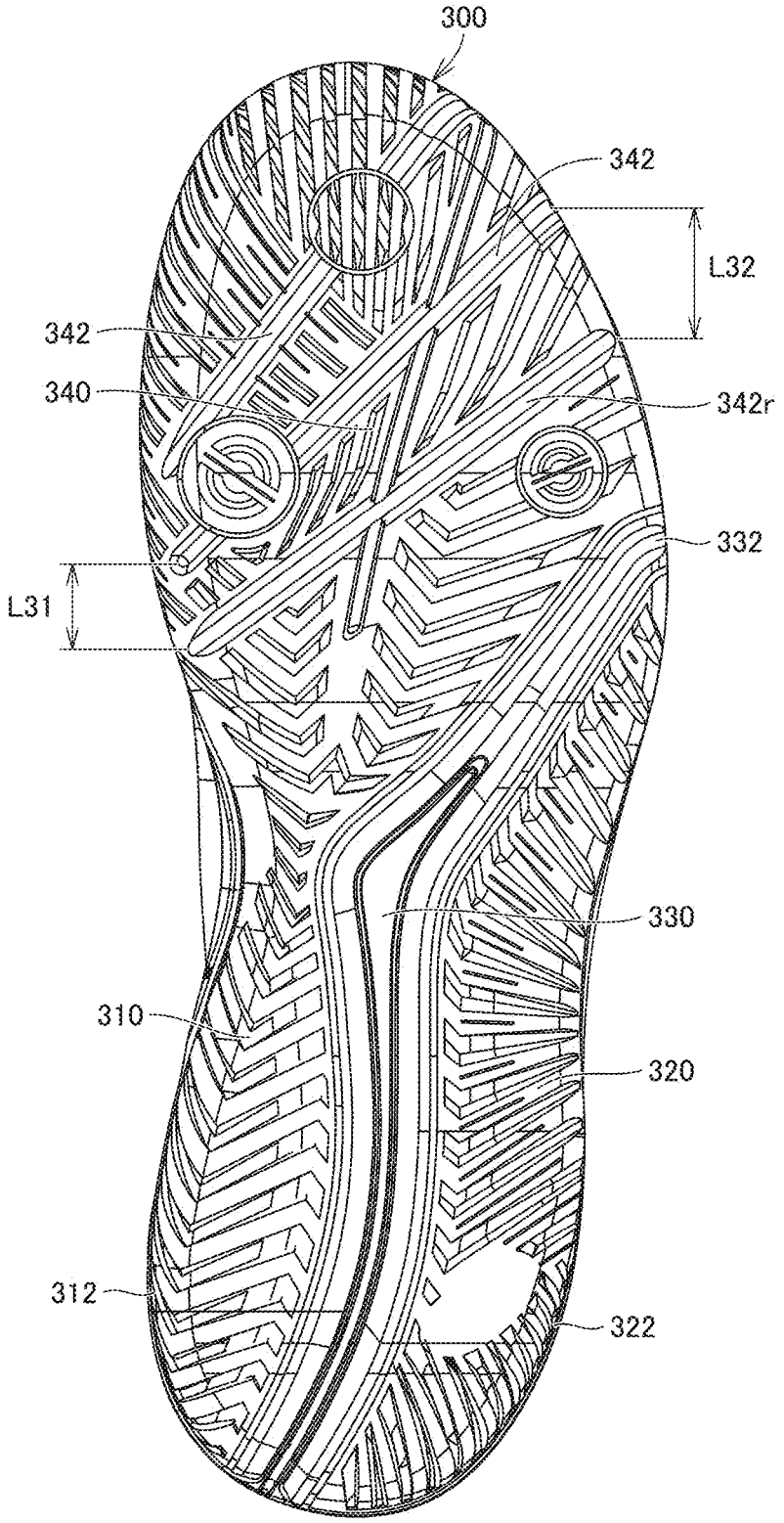
FIG. 4 is a bottom view of a sole.

FIG. 4 is a bottom view of the sole. As shown in FIG. 4, the outsole 300 has an inner ground contact portion 310, an outer ground contact portion 320, an inner/outer separation groove 330, and a front ground contact portion 340.

The inner ground contact portion 310 is arranged on the inner side in the foot width direction. The inner ground contact portion 310 includes an inner edge portion 312. The inner edge portion 312 is an edge portion that overlaps with the rearfoot portion of the wearer in the thickness direction of the shoe 1 and is located on the inner side in the foot width direction. The inner ground contact portion 310 has a shape extending in the foot length direction. In the present embodiment, the inner ground contact portion 310 has a shape extending frontward in the foot length direction from a rear end of the outsole 300.

The outer ground contact portion 320 is arranged on the outer side in the foot width direction. The outer ground contact portion 320 includes an outer edge portion 322. The outer edge portion 322 is an edge portion that overlaps with the rearfoot portion of the wearer in the thickness direction of the shoe 1 and is located on the outer side in the foot width direction. The outer ground contact portion 320 has a shape extending in the foot length direction. In the present embodiment, the outer ground contact portion 320 has a shape extending frontward in the foot length direction from the rear end of the outsole 300.

Figure 5:
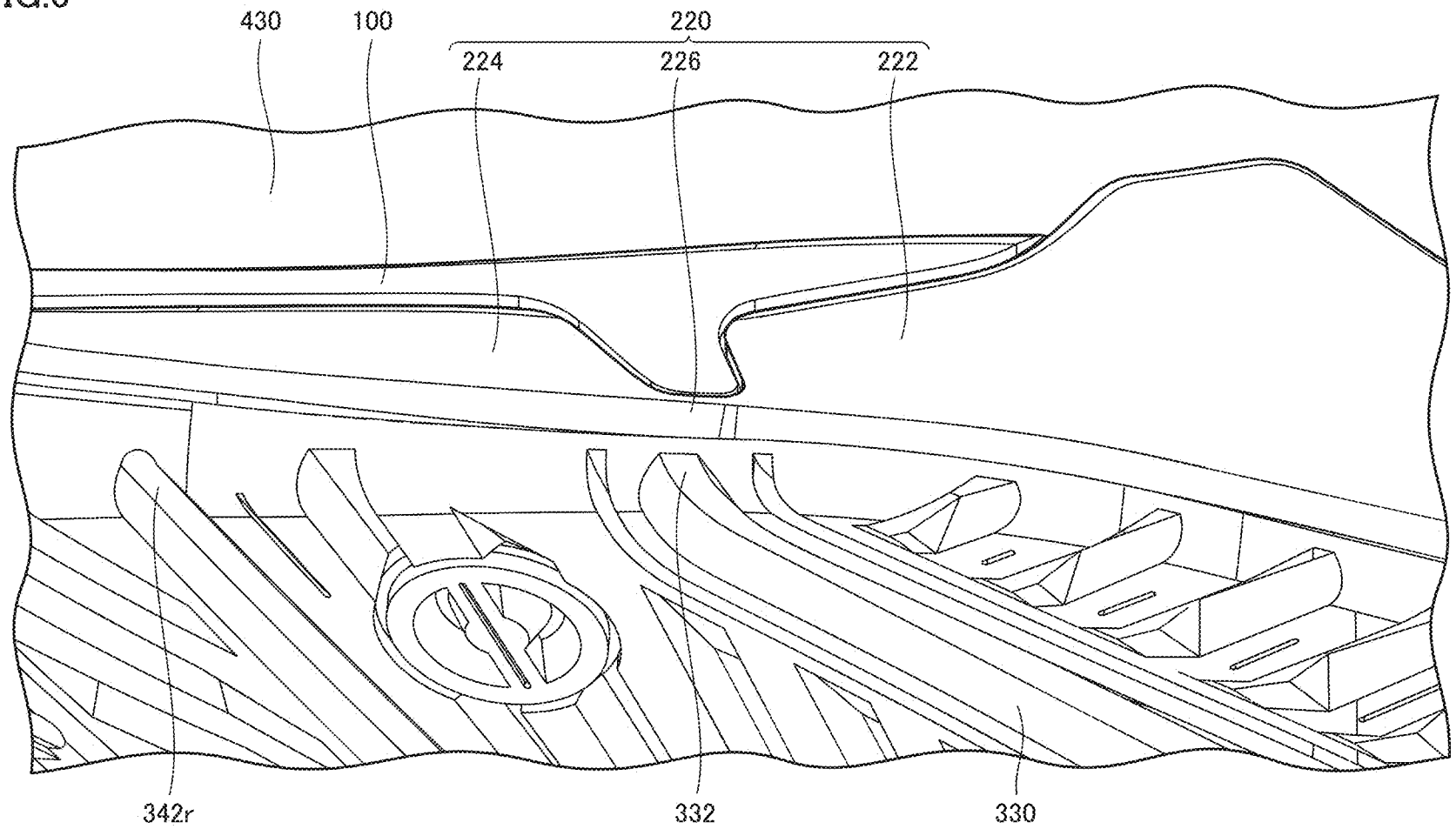
FIG. 5 is an enlarged perspective view schematically showing a positional relationship between an outer reinforcing portion and a front end of an inner/outer separation groove.

The inner/outer separation groove 330 is formed between the inner ground contact portion 310 and the outer ground contact portion 320, to separate the inner ground contact portion 310 and the outer ground contact portion 320. The inner/outer separation groove 330 has a shape extending frontward in the foot length direction from the rear end of the outsole 300. A front end 332 of the inner/outer separation groove 330 in the foot length direction is located at an outer edge portion of the outsole 300 in the foot width direction. As shown in FIG. 5, the front end 332 is formed at a position overlapping with the bend allowing portion 226 in the thickness direction.

The front ground contact portion 340 is formed at a position overlapping with a front part of the forefoot portion of the wearer in the thickness direction of the shoe 1. The front ground contact portion 340 is a region located in a range of approximately 0% to 40% from the front end to the rear end of the shoe 1 with respect to the total length of the shoe 1 along the shoe center SC.

Figure 6:
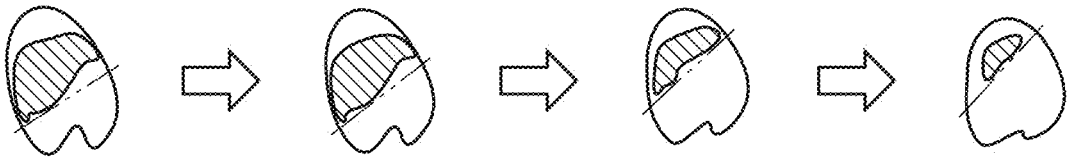
FIG. 6 is a diagram schematically showing a shift of a ground contact region of the sole at the time of a cutting maneuver.

A shift of a ground contact region of the outsole 300 at the time of a cutting maneuver will now be described with reference to FIG. 6. FIG. 6 shows the ground contact region of the outsole 300 from when the foot contacts the ground to when the foot takes off the ground (leaves the ground) at the time of a cutting maneuver. In FIG. 6, the ground contact region is indicated by diagonal lines, and a rear end of the ground contact region is indicated by a dash-dot-dot line.

As shown in FIG. 6, from the early stage of ground contact to take-off, the rear end of the ground contact region gradually moves frontward in the foot length direction. More specifically, an outer side of the rear end of the ground contact region in the foot width direction moves more frontward than an inner side of the rear end of the ground contact region in the foot width direction. In other words, from the early stage of ground contact to take-off, an amount of frontward movement of an end on the outer side in the foot width direction, of the rear end of the ground contact region, is larger than an amount of frontward movement of an end on the inner side in the foot width direction, of the rear end of the ground contact region. In order to make this shift of the ground contact region smooth, a groove that defines a bending portion of the outsole 300 at the time of a cutting maneuver (hereinafter, referred to as "bend guiding groove 342") is provided in the outsole 300.

As shown in FIG. 4, a plurality of (in the present embodiment, three) bend guiding grooves 342 are formed in the front ground contact portion 340. The plurality of bend guiding grooves 342 are arranged so as to be spaced apart from each other and aligned in the foot length direction. Each of the plurality of bend guiding grooves 342 has a shape extending continuously or intermittently from an inner edge portion to an outer edge portion of the front ground contact portion 340 in the foot width direction. Each of the bend guiding grooves 342 is formed to have a shape based on the shift of the rear end of the ground contact region shown in FIG. 6. Each of the bend guiding grooves 342 has a shape extending gradually frontward in the foot length direction, toward the outer side in the foot width direction. Each of the bend guiding grooves 342 has a shape extending linearly. A length L32 between edges on the outer side in the foot width direction, of the bend guiding grooves 342 adjacent to each other in the foot length direction, is longer than a length L31 between edges on the inner side in the foot width direction, of the bend guiding grooves 342 adjacent to each other in the foot length direction.

Figure 7:
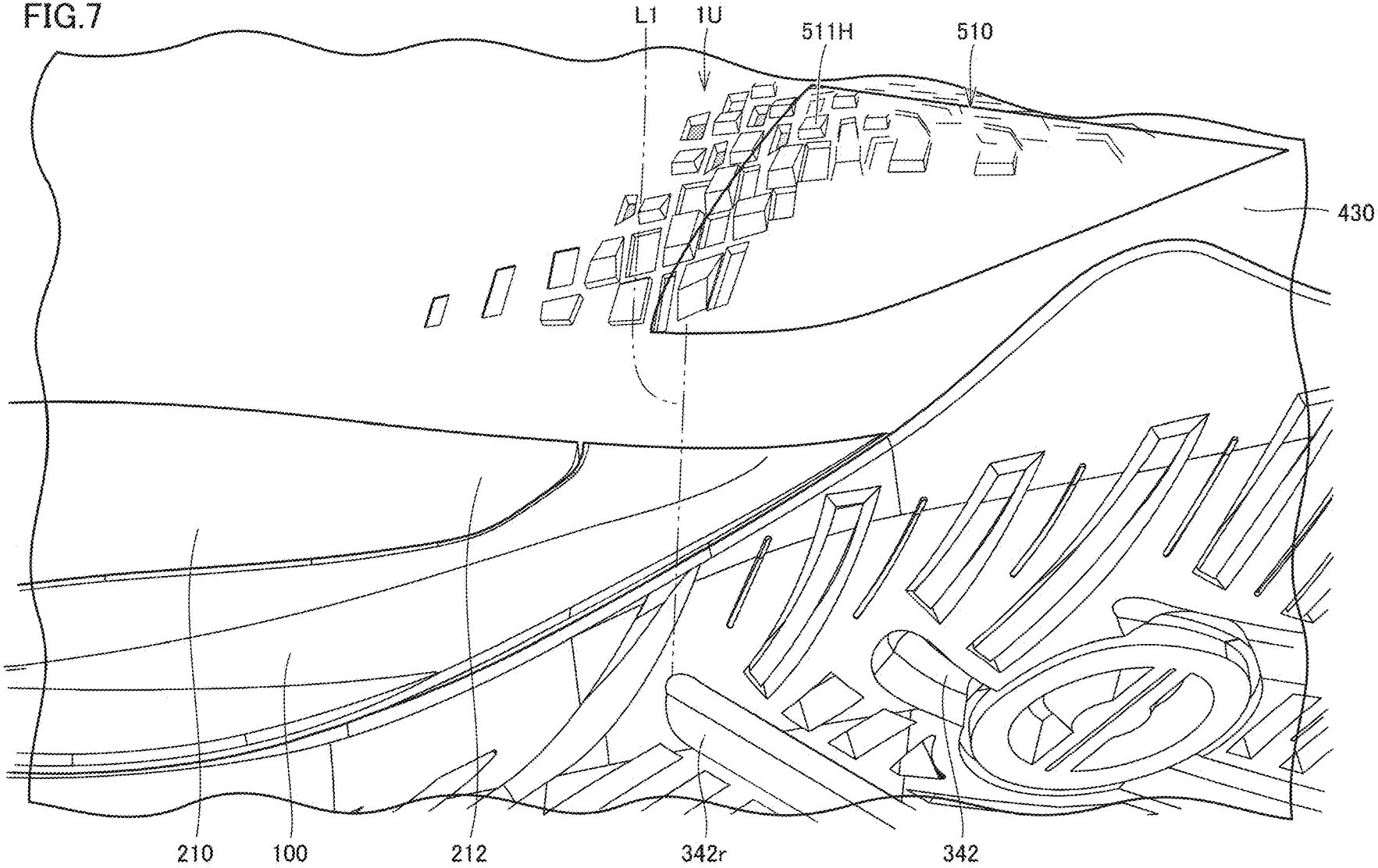
FIG. 7 is an enlarged perspective view schematically showing a positional relationship among an inner functional portion, a front end of an inner reinforcing portion, and a bend guiding groove.

The plurality of bend guiding grooves 342 include a rearmost bend guiding groove 342*r* located rearmost in the foot length direction. As shown in FIG. 4, an outer edge of the rearmost bend guiding groove 342*r* in the foot width direction is located more frontward in the foot length direction than the front end 332 of the inner/outer separation groove 330. As shown in FIG. 7, an inner edge of the rearmost bend guiding groove 342*r* in the foot length direction is located more frontward in the foot length direction than the front end 212 of the inner reinforcing portion 210.

<Upper>

Next, the upper 1U will be described.

The upper 1U is located above the sole 1S and is connected to the sole 1S. The upper 1U forms a space that accommodates the foot of the wearer, together with the sole 1S. The upper 1U covers an upper surface of the foot. The upper 1U includes a topline portion 410, a slit portion 420, a peripheral edge portion 430, and a forefoot portion covering portion 500.

The topline portion 410 is a portion that allows the wearer of the shoe 1 to put the foot of the wearer in and out of the shoe 1. The topline portion 410 is opened upward.

The slit portion 420 defines an opening extending frontward in the foot length direction from the topline portion 410. An insertion hole through which a shoelace is inserted is formed in the slit portion 420.

The peripheral edge portion 430 is a portion that constitutes a peripheral edge of the upper 1U. The peripheral edge portion 430 is connected to the sole 1S. Specifically, the peripheral edge portion 430 is connected to the midsole 100. The peripheral edge portion 430 is made of polyurethane (PU) or the like. The peripheral edge portion 430 is continuous along the peripheral edge of the upper 1U. A surface of the peripheral edge portion 430 may be formed to be smooth. The peripheral edge portion 430 is formed in a range of approximately 1 mm to 20 mm from an upper end of the midsole 100 to the upper side.

The forefoot portion covering portion 500 covers the forefoot portion of the wearer. The forefoot portion covering portion 500 has a base portion made of a mesh fabric, and a strength portion provided on the base portion. The strength portion has a bending rigidity higher than a bending rigidity of the base portion. The strength portion is made of polyurethane (PU) or the like.

The bending rigidity refers to rigidity when a target portion is bent with respect to a straight line parallel to the foot width direction. For example, the bending rigidity of the strength portion refers to rigidity when the strength portion is bent with respect to the straight line parallel to the foot width direction. The bending rigidity is measured by a so-called three-point bending test or the like.

Figure 8:
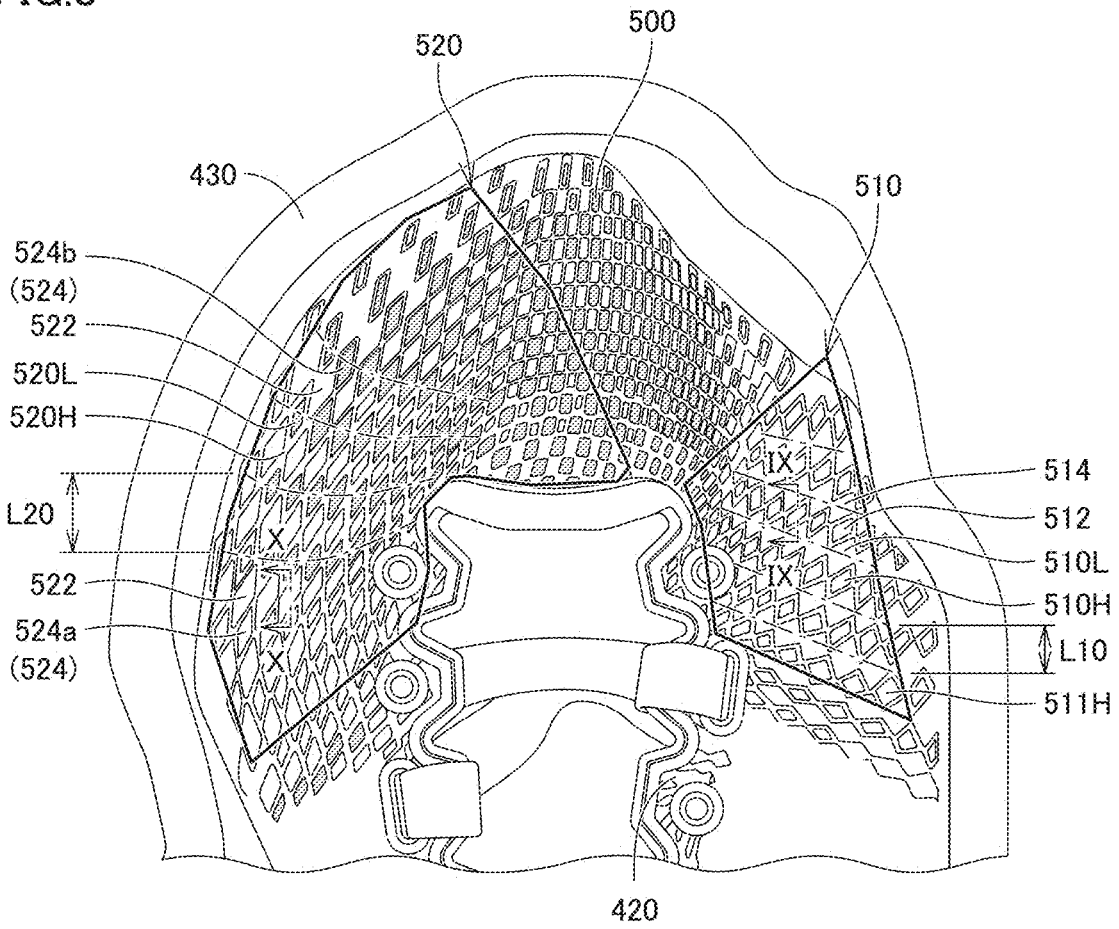
FIG. 8 is an exploded view of a forefoot portion covering portion.

FIG. 8 is an exploded view of the forefoot portion covering portion 500. As shown in FIGS. 1 to 3 and 8, the forefoot portion covering portion 500 has an inner functional portion 510 and an outer functional portion 520.

The inner functional portion 510 is formed on the inner side in the foot width direction and between the slit portion 420 and the peripheral edge portion 430. The inner functional portion 510 has a function of suppressing breakage of the base portion caused by friction. As shown in FIG. 3, the inner functional portion 510 is formed in a range overlapping with the thenar eminence of the foot of the wearer in the foot width direction. As shown in FIG. 8, the inner functional portion 510 has a plurality of inner high rigidity portions 510H and a plurality of inner low rigidity portions 510L.

The plurality of inner high rigidity portions 510H are arranged so as to be aligned in the foot length direction. Each of the plurality of inner high rigidity portions 510H has a shape extending in the foot width direction. Each of the inner high rigidity portions 510H has a shape extending continuously from the slit portion 420 to the peripheral edge portion 430. Therefore, the tensile force from the shoelace is effectively transmitted to the peripheral edge portion 430. Each of the inner high rigidity portions 510H constitutes a part of the strength portion. That is, each of the inner high rigidity portions 510H is made of polyurethane (PU) or the like.

As shown in FIG. 8, the plurality of inner high rigidity portions 510H include a rearmost inner high rigidity portion 511H located rearmost in the foot length direction. As shown in FIG. 7, the front end 212 of the inner reinforcing portion 210 in the foot length direction is located more rearward in the foot length direction than a line segment L1 that connects an inner end of the rearmost inner high rigidity portion 511H in the foot length direction and an inner end of the rearmost bend guiding groove 342*r* in the foot length direction.

As shown in FIG. 8, each of the inner high rigidity portions 510H has a plurality of inner high rigidity elements 512 coupled to each other in the foot width direction. Each of the inner high rigidity elements 512 adjacent to each other in the foot length direction has such a shape that a length in the foot width direction becomes gradually shorter as the inner high rigidity elements 512 become closer to each other. Each of the inner high rigidity elements 512 is formed to have a rectangular shape. Each of the inner high rigidity elements 512 is preferably formed to have a rhombus shape. Corners of the inner high rigidity elements 512 adjacent to each other in the foot length direction are preferably in contact with or close to each other.

The plurality of inner low rigidity portions 510L are arranged between the inner high rigidity portions 510H adjacent to each other in the foot length direction. Each of the plurality of inner low rigidity portions 510L has a bending rigidity lower than a bending rigidity of each of the plurality of inner high rigidity portions 510H. Each of the inner low rigidity portions 510L has a shape extending in the foot width direction. Each of the inner low rigidity portions 510L has a shape extending continuously from the slit portion 420 to the peripheral edge portion 430. The position and shape of each of the inner low rigidity portions 510L shown in FIG. 8 are set based on the shift of the rear end of the ground contact region shown in FIG. 6.

As shown in FIG. 8, each of the inner low rigidity portions 510L has a plurality of inner low rigidity elements 514 coupled to each other in the foot width direction. Each of the inner low rigidity elements 514 adjacent to each other in the foot length direction has such a shape that a length in the foot width direction becomes gradually shorter as the inner low rigidity elements 514 become closer to each other. Each of the inner low rigidity elements 514 is formed to have a rectangular shape. Each of the inner low rigidity elements 514 is preferably formed to have a rhombus shape. Corners of the inner low rigidity elements 514 adjacent to each other in the foot length direction are preferably in contact with or close to each other.

Figure 9:
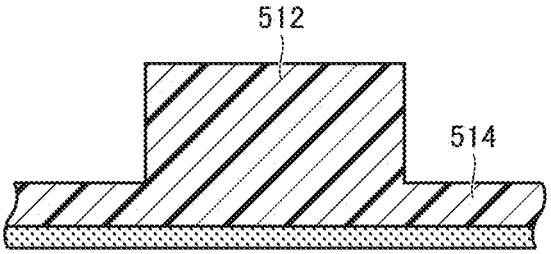
FIG. 9 is a cross-sectional view taken along line IX-IX in FIG. 8.

As shown in FIG. 9, a thickness of each of the inner high rigidity elements 512 is greater than a thickness of each of the inner low rigidity elements 514. The inner low rigidity element 514 may be made of the same material (such as polyurethane) as a material of the inner high rigidity element 512, or may be made of the same material (mesh fabric) as the material of the base portion.

The outer functional portion 520 is formed on the outer side of the inner functional portion 510 in the foot width direction and between the slit portion 420 and the peripheral edge portion 430. The outer functional portion 520 has a function of restricting displacement of the foot in the shoe 1 while ensuring the fit of the upper 1U to the foot. As shown in FIG. 3, the outer functional portion 520 is formed in a range from a region located frontward of the slit portion 420 to a region located more rearward than a position overlapping with the MP joint of the foot of the wearer in the foot width direction. An area of the outer functional portion 520 is larger than an area of the inner functional portion 510. As shown in FIG. 8, the outer functional portion 520 has a plurality of outer high rigidity portions 520H and a plurality of outer low rigidity portions 520L.

The plurality of outer high rigidity portions 520H are arranged so as to be aligned in the foot length direction. Each of the plurality of outer high rigidity portions 520H has a shape extending in the foot width direction. Each of the outer high rigidity portions 520H has a shape extending continuously from the slit portion 420 to the peripheral edge portion 430. Therefore, the tensile force from the shoelace is effectively transmitted to the peripheral edge portion 430. Each of the outer high rigidity portions 520H constitutes a part of the strength portion. That is, each of the outer high rigidity portions 520H is made of polyurethane (PU) or the like.

As shown in FIG. 8, each of the outer high rigidity portions 520H has a plurality of outer high rigidity elements 522 coupled to each other in the foot width direction. Each of the outer high rigidity elements 522 adjacent to each other in the foot length direction has such a shape that a length in the foot width direction becomes gradually shorter as the outer high rigidity elements 522 become closer to each other. Each of the outer high rigidity elements 522 is formed to have a rectangular shape. Each of the outer high rigidity elements 522 is preferably formed to have a rhombus shape. Corners of the outer high rigidity elements 522 adjacent to each other in the foot length direction are preferably in contact with or close to each other.

The plurality of outer low rigidity portions 520L are arranged between the outer high rigidity portions 520H adjacent to each other in the foot length direction. Each of the plurality of outer low rigidity portions 520L has a bending rigidity lower than a bending rigidity of each of the plurality of outer high rigidity portions 520H. Each of the outer low rigidity portions 520L has a shape extending in the foot width direction. Each of the outer low rigidity portions 520L has a shape extending continuously from the slit portion 420 to the peripheral edge portion 430.

As shown in FIG. 8, a length between the outer low rigidity portions 520L adjacent to each other in the foot length direction becomes gradually longer toward the outer side in the foot width direction. The position and shape of each of the outer low rigidity portions 520L shown in FIG. 8 are set based on the shift of the rear end of the ground contact region shown in FIG. 6.

As shown in FIG. 8, a length L20 between ends on the outer side in the foot width direction, of the outer low rigidity portions 520L adjacent to each other in the foot length direction, is longer than a length L10 between ends on the inner side in the foot width direction, of the inner low rigidity portions 510L adjacent to each other in the foot length direction. The above-described length L20 is preferably equal to or more than 1.5 times and equal to or less than 5 times, and more preferably equal to or more than 2 times and equal to or less than 3 times the above-described length L10.

It should be noted that "ends on the outer side in the foot width direction, of the outer low rigidity portions 520L" refer to a boundary portion between the outer low rigidity portions 520L and the peripheral edge portion 430, and "ends on the inner side in the foot width direction, of the inner low rigidity portions 510L" refer to a boundary portion between the inner low rigidity portions 510L and the peripheral edge portion 430.

As shown in FIG. 8, each of the outer low rigidity portions 520L has a plurality of outer low rigidity elements 524 coupled to each other in the foot width direction. Each of the outer low rigidity elements 524 adjacent to each other in the foot length direction has such a shape that a length in the foot width direction becomes gradually shorter as the outer low rigidity elements 524 become closer to each other. Each of the outer low rigidity elements 524 is formed to have a rectangular shape. Each of the outer low rigidity elements 524 is preferably formed to have a rhombus shape. Corners of the outer low rigidity elements 524 adjacent to each other in the foot length direction are preferably in contact with or close to each other.

Figure 10:
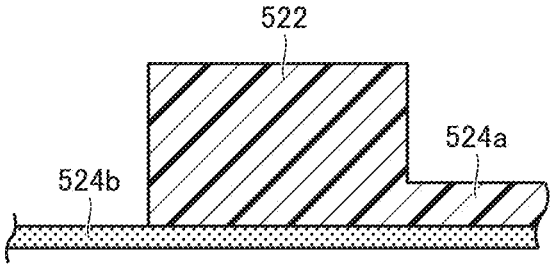
FIG. 10 is a cross-sectional view taken along line X-X in FIG. 8.

As shown in FIG. 10, a thickness of each of the outer high rigidity elements 522 is greater than a thickness of each of the outer low rigidity elements 524. The outer low rigidity element 524 has a resin portion 524*a* made of the same material (such as polyurethane) as a material of the outer high rigidity element 522, and a fabric portion 524*b* made of the same material (mesh fabric) as the material of the base portion.

As described above, in the shoe 1 according to the present embodiment, the inner low rigidity portions 510L and the inner high rigidity portions 510H are alternately aligned in the foot length direction on the inner side in the foot width direction, and the outer low rigidity portions 520L and the outer high rigidity portions 520H are alternately aligned in the foot length direction on the outer side in the foot width direction. Therefore, the forefoot portion covering portion 500 of the upper 1U bends in each of the low rigidity portions 510L and 520L at the time of a so-called cutting maneuver. Since the length L20 between the ends on the outer side in the foot width direction, of the outer low rigidity portions 520L adjacent to each other in the foot length direction, is longer than the length L10 between the ends on the inner side in the foot width direction, of the inner low rigidity portions 510L adjacent to each other in the foot length direction, the forefoot portion covering portion 500 effectively fits the forefoot portion of the wearer when the bending portion of the forefoot portion covering portion 500 shifts toward the front from the early stage of ground contact to take-off. Therefore, generation of creases in the forefoot portion covering portion 500 is effectively suppressed.

Modifications of the above-described embodiment will be described below.

First Modification

Figure 11:
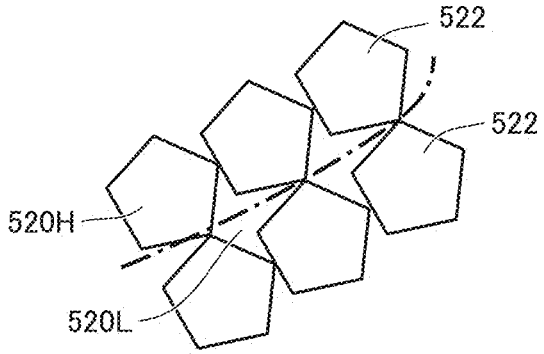
FIG. 11 is a diagram schematically showing a modification of an outer high rigidity portion and an outer low rigidity portion.
Figure 12:
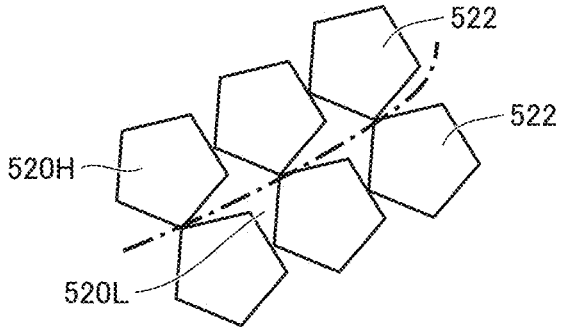
FIG. 12 is a diagram schematically showing a modification of the outer high rigidity portion and the outer low rigidity portion.
Figure 13:
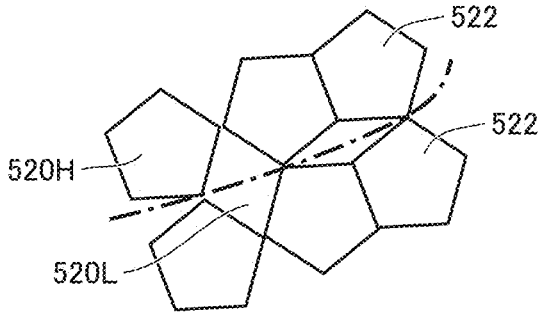
FIG. 13 is a diagram schematically showing a modification of the outer high rigidity portion and the outer low rigidity portion.
Figure 14:
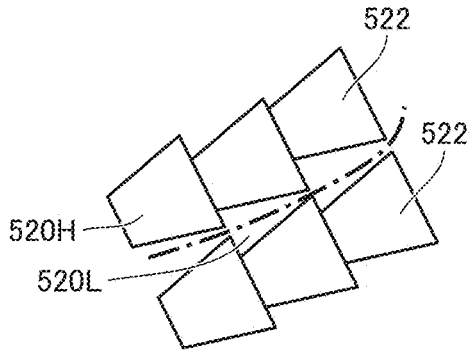
FIG. 14 is a diagram schematically showing a modification of the outer high rigidity portion and the outer low rigidity portion.
Figure 15:
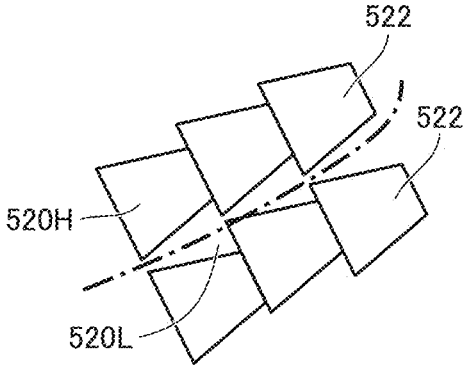
FIG. 15 is a diagram schematically showing a modification of the outer high rigidity portion and the outer low rigidity portion.
Figure 16:
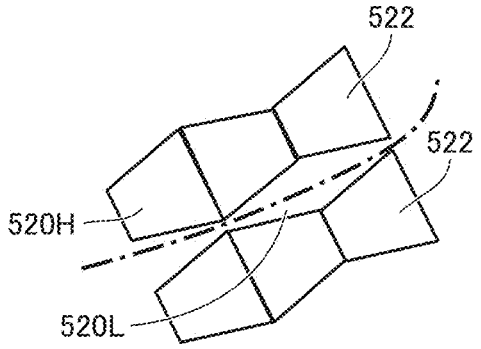
FIG. 16 is a diagram schematically showing a modification of the outer high rigidity portion and the outer low rigidity portion.
Figure 17:
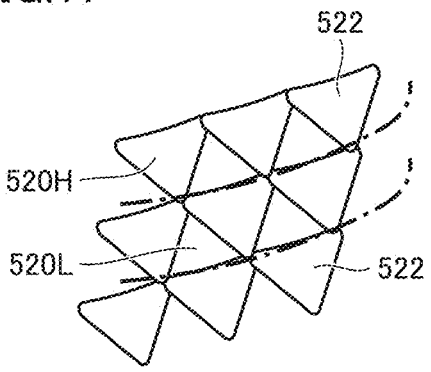
FIG. 17 is a diagram schematically showing a modification of the outer high rigidity portion and the outer low rigidity portion.
Figure 18:
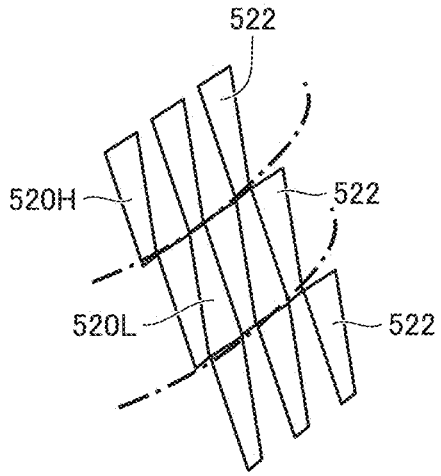
FIG. 18 is a diagram schematically showing a modification of the outer high rigidity portion and the outer low rigidity portion.

Each of the inner high rigidity elements 512 and the outer high rigidity elements 522 may be formed to have a convex polygonal external shape. Each of FIGS. 11 to 13 shows an example in which each of the outer high rigidity elements 522 is formed to have a pentagonal external shape. Each of FIGS. 14 to 16 shows an example in which each of the outer high rigidity elements 522 is formed to have a trapezoidal external shape. FIG. 17 shows an example in which each of the outer high rigidity elements 522 is formed to have a triangular external shape. FIG. 18 shows an example in which each of the outer high rigidity elements 522 is formed to have a rectangular external shape. In any of the examples, corners of the outer high rigidity elements 522 adjacent to each other in the foot length direction are in contact with or close to each other.

Second Modification

Each of the inner high rigidity elements 512 and the outer high rigidity elements 522 may be formed to have a concave polygonal external shape.

Figure 19:
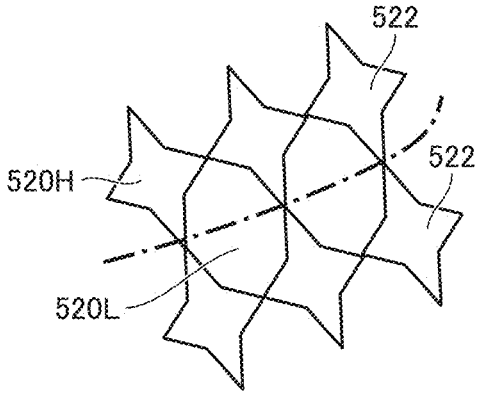
FIG. 19 is a diagram schematically showing a modification of the outer high rigidity portion and the outer low rigidity portion.

FIG. 19 shows an example in which each of the outer high rigidity elements 522 is formed to have a concave octagonal external shape. Each of the outer high rigidity elements 522 has such a shape that an acute-angled corner and an obtuse-angled corner are alternately arranged in the perimeter direction, and the acute-angled corners of the outer high rigidity elements 522 adjacent to each other in the foot length direction are in contact with or close to each other.

Figure 20:
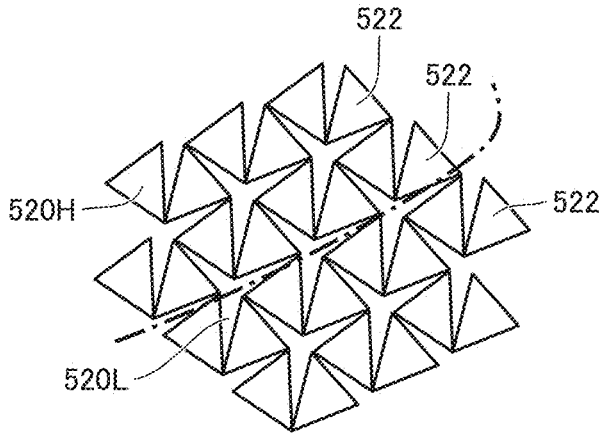
FIG. 20 is a diagram schematically showing a modification of the outer high rigidity portion and the outer low rigidity portion.

FIG. 20 shows an example in which each of the outer high rigidity elements 522 is formed to have a concave hexagonal external shape. In each of the outer high rigidity elements 522, two acute-angled corners and one obtuse-angled corner are arranged in this order in the perimeter direction, and the acute-angled corners of the outer high rigidity elements 522 adjacent to each other in the foot length direction are in contact with or close to each other.

Third Modification

The external shape of each of the inner high rigidity elements 512 and the external shape of each of the outer high rigidity elements 522 may partially include a curved portion.

Figure 21:
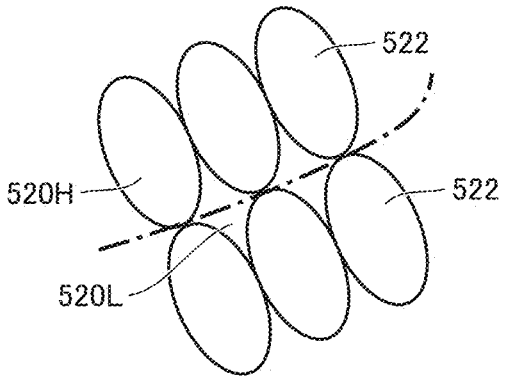
FIG. 21 is a diagram schematically showing a modification of the outer high rigidity portion and the outer low rigidity portion.

FIG. 21 shows an example in which each of outer high rigidity elements 522 is formed to have an oval external shape.

Figure 22:
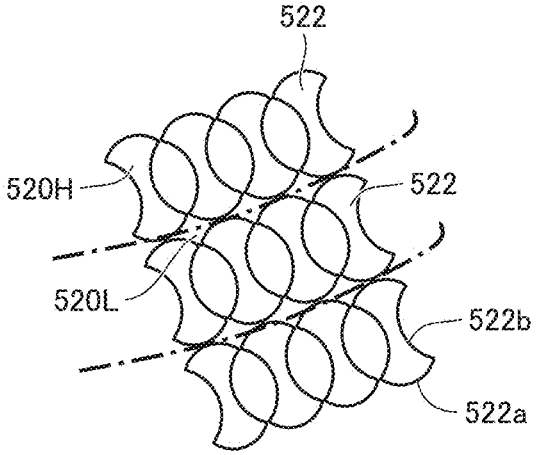
FIG. 22 is a diagram schematically showing a modification of the outer high rigidity portion and the outer low rigidity portion.

Each of the outer high rigidity elements 522 shown in FIG. 22 has a pair of first curved portions 522*a* that face each other in the foot length direction, and a pair of second curved portions 522*b* that face each other in the foot width direction. Each of the first curved portions 522*a* has a shape curved to be convex outward in the foot length direction. Each of the second curved portions 522*b* has a shape curved to be convex inward in the foot width direction. The first curved portions 522*a* of the outer high rigidity elements 522 adjacent to each other in the foot length direction are in contact with or close to each other.

Figure 23:
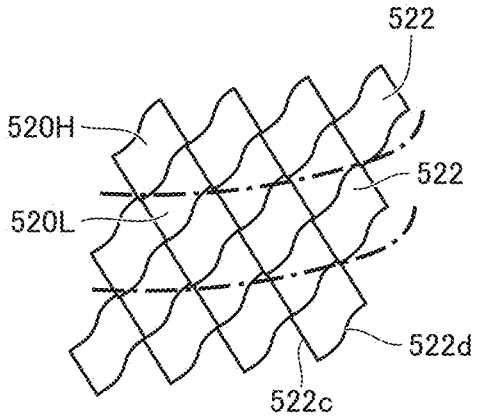
FIG. 23 is a diagram schematically showing a modification of the outer high rigidity portion and the outer low rigidity portion.

Each of the outer high rigidity elements 522 shown in FIG. 23 has a pair of straight portions 522*c* that face each other, and a pair of curved portions 522*d* that face each other. Each of the curved portions 522*d* has an inflection point. Corners formed by the straight portions 522*c* and the curved portions 522*d*, of the outer high rigidity elements 522 adjacent to each other in the foot length direction, are in contact with or close to each other.

Figure 24:
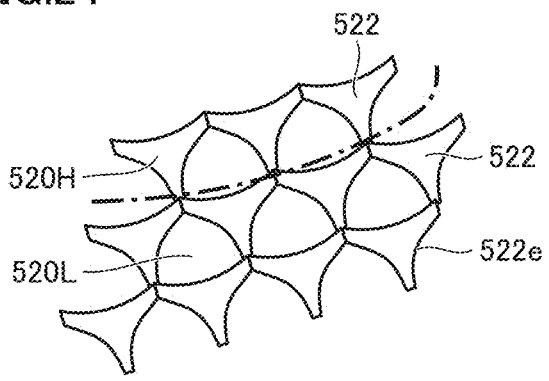
FIG. 24 is a diagram schematically showing a modification of the outer high rigidity portion and the outer low rigidity portion.

Each of the outer high rigidity elements 522 shown in FIG. 24 has three curved portions 522*e*. Each of the curved portions 522*e* has a shape curved to be convex inward of the outer high rigidity element 522. Corners of the outer high rigidity elements 522 adjacent to each other in the foot length direction are in contact with or close to each other.

It will be understood by those skilled in the art that the exemplary embodiment described above is a specific example of the aspects described below.

Aspect 1

A shoe comprising a sole and an upper, wherein the upper includes:

a topline portion that allows a wearer of the shoe to put a foot of the wearer in and out of the shoe;

a slit portion that defines an opening extending frontward in a foot length direction from the topline portion;

an edge portion connected to the sole; and a forefoot portion covering portion that covers a forefoot portion of the wearer of the shoe, the forefoot portion covering portion includes:

an inner functional portion formed on an inner side in a foot width direction and between the slit portion and the edge portion; and an outer functional portion formed on an outer side of the inner functional portion in the foot width direction and between the slit portion and the edge portion, the inner functional portion has:

a plurality of inner high rigidity portions arranged so as to be aligned in the foot length direction, each of the plurality of inner high rigidity portions having a shape extending in the foot width direction; and a plurality of inner low rigidity portions arranged between the inner high rigidity portions adjacent to each other in the foot length direction, each of the plurality of inner low rigidity portions having a bending rigidity lower than a bending rigidity of each of the plurality of inner high rigidity portions and having a shape extending in the foot width direction, the outer functional portion has:

a plurality of outer high rigidity portions arranged so as to be aligned in the foot length direction, each of the plurality of outer high rigidity portions having a shape extending in the foot width direction; and a plurality of outer low rigidity portions arranged between the outer high rigidity portions adjacent to each other in the foot length direction, each of the plurality of outer low rigidity portions having a bending rigidity lower than a bending rigidity of each of the plurality of outer high rigidity portions and having a shape extending in the foot width direction, and a length between ends on an outer side in the foot width direction, of the outer low rigidity portions adjacent to each other in the foot length direction, is longer than a length between ends on the inner side in the foot width direction, of the inner low rigidity portions adjacent to each other in the foot length direction.

In this shoe, the inner low rigidity portions and the inner high rigidity portions are alternately aligned in the foot length direction on the inner side in the foot width direction, and the outer low rigidity portions and the outer high rigidity portions are alternately aligned in the foot length direction on the outer side in the foot width direction. Therefore, the forefoot portion covering portion of the upper bends in each of the low rigidity portions at the time of a so-called cutting maneuver. Since the length between the ends on the outer side in the foot width direction, of the outer low rigidity portions adjacent to each other in the foot length direction, is longer than the length between the ends on the inner side in the foot width direction, of the inner low rigidity portions adjacent to each other in the foot length direction, the forefoot portion covering portion effectively fits the forefoot portion of the wearer when the bending portion of the forefoot portion covering portion shifts toward the front from the early stage of ground contact to take-off. Therefore, generation of creases in the forefoot portion covering portion is suppressed.

Aspect 2

The shoe according to aspect 1, wherein a length between the outer low rigidity portions adjacent to each other in the foot length direction becomes gradually longer toward the outer side in the foot width direction.

In this aspect, generation of creases in the forefoot portion covering portion is suppressed more reliably.

Aspect 3

The shoe according to aspect 1 or 2, wherein the length between the ends on the outer side in the foot width direction, of the outer low rigidity portions adjacent to each other in the foot length direction, is equal to or more than 1.5 times and equal to or less than 5 times the length between the ends on the inner side in the foot width direction, of the inner low rigidity portions adjacent to each other in the foot length direction.

Aspect 4

The shoe according to any one of aspects 1 to 3, wherein each of the inner high rigidity portions has a plurality of inner high rigidity elements coupled to each other in the foot width direction, each of the outer high rigidity portions has a plurality of outer high rigidity elements coupled to each other in the foot width direction, each of the inner high rigidity elements adjacent to each other in the foot length direction has such a shape that a length in the foot width direction becomes gradually shorter as the inner high rigidity elements become closer to each other, and each of the outer high rigidity elements adjacent to each other in the foot length direction has such a shape that a length in the foot width direction becomes gradually shorter as the outer high rigidity elements become closer to each other.

In this aspect, the portion of the forefoot portion covering portion that bends at the time of a cutting maneuver is effectively defined by the portion of the inner functional portion between the inner high rigidity elements adjacent to each other in the foot length direction and the portion of the outer functional portion between the outer high rigidity elements adjacent to each other in the foot length direction.

Aspect 5

The shoe according to aspect 4, wherein each of the inner high rigidity elements is formed to have a rectangular shape, and each of the outer high rigidity elements is formed to have a rectangular shape.

Aspect 6

The shoe according to any one of aspects 1 to 5, wherein the sole includes:

a midsole that supports the foot of the wearer; and an outer reinforcing portion provided on a side part of the midsole on the outer side in the foot width direction and made of a material having a hardness higher than a hardness of a material of the midsole, and the outer reinforcing portion has:

a rear reinforcing portion located more rearward in the foot length direction than an extension line of a MP joint of the foot of the wearer;

a front reinforcing portion located more frontward in the foot length direction than the extension line of the MP joint of the foot of the wearer; and a bend allowing portion located on the extension line of the MP joint of the foot of the wearer and coupling the rear reinforcing portion to the front reinforcing portion, the bend allowing portion allowing the front reinforcing portion to bend with respect to the rear reinforcing portion.

In this aspect, a decrease in compression rigidity of the midsole is suppressed and an increase in bending rigidity of the sole in the vicinity of the MP joint of the foot of the wearer is suppressed.

Aspect 7

The shoe according to aspect 6, wherein the sole further includes an outsole arranged on a lower surface side of the midsole.

Aspect 8

The shoe according to aspect 7, wherein the outsole has:

an inner ground contact portion including an inner edge portion that overlaps with a rearfoot portion of the wearer in a thickness direction of the shoe and is located on the inner side in the foot width direction, the inner ground contact portion having a shape extending in the foot length direction;

an outer ground contact portion including an outer edge portion that overlaps with the rearfoot portion of the wearer in the thickness direction and is located on the outer side in the foot width direction, the outer ground contact portion having a shape extending in the foot length direction; and an inner/outer separation groove formed between the inner ground contact portion and the outer ground contact portion, to separate the inner ground contact portion and the outer ground contact portion, and a front end of the inner/outer separation groove in the foot length direction is formed at a position overlapping with the bend allowing portion in the thickness direction.

In this aspect, relative displacement of the outer ground contact portion with respect to the inner ground contact portion at the time of a cutting maneuver is allowed and bending of the sole in the vicinity of the MP joint of the foot of the wearer is promoted.

Aspect 9

The shoe according to aspect 7 or 8, wherein the outsole includes a front ground contact portion overlapping with the forefoot portion covering portion in a thickness direction of the shoe, a plurality of bend guiding grooves arranged so as to be aligned in the foot length direction are formed in the front ground contact portion, each of the plurality of bend guiding grooves having a shape extending continuously or intermittently from an inner edge portion to an outer edge portion in the foot width direction, and a length between ends on the outer side in the foot width direction, of the bend guiding grooves adjacent to each other in the foot length direction, is longer than a length between ends on the inner side in the foot width direction, of the bend guiding grooves adjacent to each other in the foot length direction.

In this aspect, the bending portion of the outsole effectively shifts toward the front from the early stage of ground contact to take-off at the time of a cutting maneuver.

Aspect 10

The shoe according to aspect 9, wherein the sole further includes an inner reinforcing portion provided on a side part of the midsole on the inner side in the foot width direction and made of a material having a hardness higher than a hardness of a material of the midsole, the plurality of inner high rigidity portions include a rearmost inner high rigidity portion located at a rearmost position in the foot length direction, the plurality of bend guiding grooves include a rearmost bend guiding groove located at a rearmost position in the foot length direction, and a front end of the inner reinforcing portion in the foot length direction is located more rearward in the foot length direction than a line segment that connects an inner end of the rearmost inner high rigidity portion in the foot length direction and an inner end of the rearmost bend guiding groove in the foot length direction.

In this aspect, inward twisting of the heel side of the midsole with respect to the toe side of the midsole when the foot takes off the ground at the time of a cutting maneuver is allowed and bending of the sole in the vicinity of the MP joint of the foot of the wearer is promoted.

It should be understood that the embodiment disclosed herein is illustrative and non-restrictive in every respect. The scope of the present invention is defined by the scope of the claims, rather than the description of the embodiment above, and is intended to include any modifications within the scope and meaning equivalent to the scope of the claims.

REFERENCE SIGNS LIST

1 shoe; 1S sole; 1U upper; 100 midsole; 210 inner reinforcing portion; 220 outer reinforcing portion; 222 rear reinforcing portion; 224 front reinforcing portion; 226 bend allowing portion; 230 heel reinforcing portion; 300 outsole; 310 inner ground contact portion; 320 outer ground contact portion; 330 inner/outer separation groove; 332 front end; 340 front ground contact portion; 342 bend guiding groove; 342*r* rearmost bend guiding groove; 410 topline portion; 420 slit portion; 430 peripheral edge portion; 500 forefoot portion covering portion; 510 inner functional portion; 510H inner high rigidity portion; 510L inner low rigidity portion; 512 inner high rigidity element; 514 inner low rigidity element; 520 outer functional portion; 520H outer high rigidity portion; 520L outer low rigidity portion; 522 outer high rigidity element; 524 outer low rigidity element 524; R1 forefoot region; R2 rearfoot region; SC shoe center.

The invention claimed is:

1. A shoe comprising a sole and an upper, wherein the upper includes:

a topline portion configured to allow a wearer of the shoe to put a foot of the wearer in and out of the shoe;

a slit portion that defines an opening extending frontward in a foot length direction from the topline portion;

a peripheral edge portion connected to the sole; and a forefoot portion covering portion that covers a forefoot portion of the wearer of the shoe, the forefoot portion covering portion includes:

an inner functional portion formed on an inner side of the forefoot portion, in a foot width direction and between the slit portion and the peripheral edge portion; and an outer functional portion formed on an outer side of the forefoot portion, in the foot width direction and between the slit portion and the peripheral edge portion, the inner functional portion has:

a plurality of inner high rigidity portions arranged so as to be aligned in the foot length direction, each of the plurality of inner high rigidity portions having a shape extending in the foot width direction; and a plurality of inner low rigidity portions arranged between the inner high rigidity portions and adjacent to each other in the foot length direction, each of the plurality of inner low rigidity portions having a bending rigidity lower than a bending rigidity of each of the plurality of inner high rigidity portions and having a shape extending in the foot width direction, the outer functional portion has:

a plurality of outer high rigidity portions arranged so as to be aligned in the foot length direction, each of the plurality of outer high rigidity portions having a shape extending in the foot width direction; and a plurality of outer low rigidity portions arranged between the outer high rigidity portions and adjacent to each other in the foot length direction, each of the plurality of outer low rigidity portions having a bending rigidity lower than a bending rigidity of each of the plurality of outer high rigidity portions and having a shape extending in the foot width direction, a length between ends, on an outer side in the foot width direction, of the outer low rigidity portions adjacent to each other in the foot length direction is longer than a length between ends, on an inner side in the foot width direction, of the inner low rigidity portions adjacent to each other in the foot length direction, and the ends, on the outer side in the foot width direction, of the outer low rigidity portions are disposed at a boundary between the outer low rigidity portions and the peripheral edge portion, and the ends, on the inner side in the foot width direction, of the inner low rigidity portions are disposed at a boundary between the inner low rigidity portions and the peripheral edge portion.

2. The shoe according to claim 1, wherein a length between the outer low rigidity portions adjacent to each other in the foot length direction becomes gradually longer toward the outer side in the foot width direction.

3. The shoe according to claim 1, wherein the sole includes:

a midsole configured to support the foot of the wearer; and an outer reinforcing portion provided on a side part of the midsole on the outer side in the foot width direction and made of a material having a hardness higher than a hardness of a material of the midsole, and the outer reinforcing portion has:

a rear reinforcing portion configured to be located more rearward in the foot length direction than an extension line of a metatarsophalangeal (MP) joint of the foot of the wearer;

a front reinforcing portion configured to be located more frontward in the foot length direction than the extension line of the MP joint of the foot of the wearer; and a bend allowing portion configured to be located on the extension line of the MP joint of the foot of the wearer and coupling the rear reinforcing portion to the front reinforcing portion, the bend allowing portion allowing the front reinforcing portion to bend with respect to the rear reinforcing portion.

4. The shoe according to claim 3, wherein the sole further includes an outsole arranged on a lower surface side of the midsole.

5. The shoe according to claim 4, wherein the outsole has:

an inner ground contact portion including an inner edge portion configured to overlap with a rearfoot portion of the wearer in a thickness direction of the shoe and is located on the inner side in the foot width direction, the inner ground contact portion having a shape extending in the foot length direction;

an outer ground contact portion including an outer edge portion configured to overlap with the rearfoot portion of the wearer in the thickness direction and is located on the outer side in the foot width direction, the outer ground contact portion having a shape extending in the foot length direction; and an inner/outer separation groove formed between the inner ground contact portion and the outer ground contact portion, to separate the inner ground contact portion and the outer ground contact portion, and a front end of the inner/outer separation groove in the foot length direction is formed at a position overlapping with the bend allowing portion in the thickness direction.

6. The shoe according to claim 4, wherein the outsole includes a front ground contact portion overlapping with the forefoot portion covering portion in a thickness direction of the shoe, a plurality of bend guiding grooves arranged so as to be aligned in the foot length direction are formed in the front ground contact portion, each of the plurality of bend guiding grooves having a shape extending continuously or intermittently from an inner edge portion to an outer edge portion in the foot width direction, and a length between ends on the outer side in the foot width direction, of the bend guiding grooves adjacent to each other in the foot length direction, is longer than a length between ends on the inner side in the foot width direction, of the bend guiding grooves adjacent to each other in the foot length direction.

7. The shoe according to claim 6, wherein the sole further includes an inner reinforcing portion provided on a side part of the midsole on the inner side in the foot width direction and made of a material having a hardness higher than a hardness of a material of the midsole, the plurality of inner high rigidity portions include a rearmost inner high rigidity portion located at a rearmost position in the foot length direction, the plurality of bend guiding grooves include a rearmost bend guiding groove located at a rearmost position in the foot length direction, and a front end of the inner reinforcing portion in the foot length direction is located more rearward in the foot length direction than a line segment that connects an inner end of the rearmost inner high rigidity portion in the foot length direction and an inner end of the rearmost bend guiding groove in the foot length direction.

8. A shoe comprising a sole and an upper, wherein the upper includes:

a topline portion configured to allow a wearer of the shoe to put a foot of the wearer in and out of the shoe;

a slit portion that defines an opening extending frontward in a foot length direction from the topline portion;

a peripheral edge portion connected to the sole; and a forefoot portion covering portion that covers a forefoot portion of the wearer of the shoe, the forefoot portion covering portion includes:

an inner functional portion formed on an inner side of the forefoot portion, in a foot width direction and between the slit portion and the peripheral edge portion; and an outer functional portion formed on an outer side of the forefoot portion, in the foot width direction and between the slit portion and the peripheral edge portion, the inner functional portion has:

a plurality of inner high rigidity portions arranged so as to be aligned in the foot length direction, each of the plurality of inner high rigidity portions having a shape extending in the foot width direction; and a plurality of inner low rigidity portions arranged between the inner high rigidity portions and adjacent to each other in the foot length direction, each of the plurality of inner low rigidity portions having a bending rigidity lower than a bending rigidity of each of the plurality of inner high rigidity portions and having a shape extending in the foot width direction, the outer functional portion has:

a plurality of outer high rigidity portions arranged so as to be aligned in the foot length direction, each of the plurality of outer high rigidity portions having a shape extending in the foot width direction; and a plurality of outer low rigidity portions arranged between the outer high rigidity portions and adjacent to each other in the foot length direction, each of the plurality of outer low rigidity portions having a bending rigidity lower than a bending rigidity of each of the plurality of outer high rigidity portions and having a shape extending in the foot width direction, and a length between ends, on an outer side in the foot width direction, of the outer low rigidity portions adjacent to each other in the foot length direction is equal to or more than 1.5 times and equal to or less than 5 times a length between ends, on an inner side in the foot width direction, of the inner low rigidity portions adjacent to each other in the foot length direction.

9. A shoe comprising a sole and an upper, wherein the upper includes:

a topline portion configured to allow a wearer of the shoe to put a foot of the wearer in and out of the shoe;

a slit portion that defines an opening extending frontward in a foot length direction from the topline portion;

a peripheral edge portion connected to the sole; and a forefoot portion covering portion that covers a forefoot portion of the wearer of the shoe, the forefoot portion covering portion includes:

an inner functional portion formed on an inner side of the forefoot portion, in a foot width direction and between the slit portion and the peripheral edge portion; and an outer functional portion formed on an outer side of the forefoot portion, in the foot width direction and between the slit portion and the peripheral edge portion, the inner functional portion has:

a plurality of inner high rigidity portions arranged so as to be aligned in the foot length direction, each of the plurality of inner high rigidity portions having a shape extending in the foot width direction; and a plurality of inner low rigidity portions arranged between the inner high rigidity portions and adjacent to each other in the foot length direction, each of the plurality of inner low rigidity portions having a bending rigidity lower than a bending rigidity of each of the plurality of inner high rigidity portions and having a shape extending in the foot width direction, the outer functional portion has:

a plurality of outer high rigidity portions arranged so as to be aligned in the foot length direction, each of the plurality of outer high rigidity portions having a shape extending in the foot width direction; and a plurality of outer low rigidity portions arranged between the outer high rigidity portions and adjacent to each other in the foot length direction, each of the plurality of outer low rigidity portions having a bending rigidity lower than a bending rigidity of each of the plurality of outer high rigidity portions and having a shape extending in the foot width direction, a length between ends, on an outer side in the foot width direction, of the outer low rigidity portions adjacent to each other in the foot length direction is longer than a length between ends, on an inner side in the foot width direction, of the inner low rigidity portions adjacent to each other in the foot length direction, each of the inner high rigidity portions has a plurality of inner high rigidity elements coupled to each other in the foot width direction, each of the outer high rigidity portions has a plurality of outer high rigidity elements coupled to each other in the foot width direction, each of the inner high rigidity elements adjacent to each other in the foot length direction has such a shape that a length in the foot width direction becomes gradually shorter as the inner high rigidity elements become closer to each other, and each of the outer high rigidity elements adjacent to each other in the foot length direction has such a shape that a length in the foot width direction becomes gradually shorter as the outer high rigidity elements become closer to each other.

10. The shoe according to claim 9, wherein each of the inner high rigidity elements is formed to have a rectangular shape, and each of the outer high rigidity elements is formed to have a rectangular shape.

* * * * *